US005394814A

United States Patent [19]

Rutter, deceased et al.

[11] Patent Number: 5,394,814

[45] Date of Patent: Mar. 7, 1995

[54] FRONT MOUNTED BOAT LIFT

[75] Inventors: Henry A. Rutter, deceased, late of Claremore, Okla., by Rosetta F. Rutter, executrix; Todd A. Elson, Claremore, Okla.

[73] Assignee: Hydrohoist International, Inc., Claremore, Okla.

[21] Appl. No.: 42,827

[22] Filed: Apr. 5, 1993

[51] Int. Cl.[6] ..... B63C 1/02

[52] U.S. Cl. ..... 114/45

[58] Field of Search ..... 114/44–48, 114/50–54, 125; 405/3–5

[56] References Cited

U.S. PATENT DOCUMENTS

| | | | |
|---|---|---|---|
| Re. 27,090 | 3/1971 | Rutter | 61/65 |
| 3,191,389 | 6/1965 | Poe | 61/48 |
| 3,316,872 | 5/1967 | Van Eck | 114/54 |
| 3,362,172 | 1/1968 | Rutter | 61/65 |
| 3,727,415 | 4/1973 | Williams | 61/65 |
| 3,895,592 | 7/1975 | King | 114/45 |
| 4,018,179 | 4/1977 | Rutter | 114/45 |
| 4,037,421 | 7/1977 | Whitley, Jr. | 61/65 |
| 4,104,082 | 8/1978 | Boujard | 134/141 |
| 4,641,595 | 2/1987 | Pritchett | 114/44 |
| 4,934,298 | 6/1990 | Pritchett | 114/44 |
| 4,955,308 | 9/1990 | Craddock | 114/45 |
| 4,983,067 | 1/1991 | Montgomery | 405/3 |
| 5,002,000 | 3/1991 | Rutter | 114/45 |
| 5,016,685 | 5/1991 | Fender | 114/45 |
| 5,115,753 | 5/1992 | Craddock | 114/48 |
| 5,140,922 | 8/1992 | Bowman et al. | 114/45 |

*Primary Examiner*—Edwin L. Swinehart

*Attorney, Agent, or Firm*—Frank J. Catalano; Scott R. Zingerman

[57] ABSTRACT

In a front mounted lift for watercraft, the torque exerted by the lift on the dock is limited by a combination of a first buoyant force, being air trapped within the lift tanks, and a second buoyant force, being flotation devices connected to the rear of the lift. In a preferred embodiment, the primary buoyant force is achieved by the extension of an air supply and exhaust hose into each tank compartment to a level below the uppermost level of the tank chamber. When the water level in each tank compartment covers the hose opening, the air trapped in the tank provides a buoyant force to counter most of the submerged lift weight. The depth of the hose is selected so that the weight of the lift slightly exceeds the primary/buoyant force. This permits the lift to sink but significantly minimizes the torque exerted on the connection of the lift to the dock. The secondary buoyant force preferably consists of a pair of buoyant guides which prevent the rear of the lift from sinking to an undesirable depth. This secondary force further reduces the torque on the dock. These buoyant guides also serve to direct the watercraft into its proper position on the lift during the landing process and to support the watercraft in its operational attitude on the lift when the watercraft is raised out of the water.

12 Claims, 3 Drawing Sheets

FRONT MOUNTED BOAT LIFT

BACKGROUND OF THE INVENTION

This invention relates generally to watercraft equipment and more particularly concerns lifts for raising and lowering watercraft out of and into the water.

Depending on docking situations, it may be desirable or necessary to mount a lift on the dock in either a side mount or a front end mount orientation. In the front end mount orientation, the keel of the watercraft will extend perpendicularly to the edge of the dock to which the lift is mounted. In all known front mounted lifts, the front end of the lift which is the portion of the lift closest to the dock is mounted at a level significantly higher than the opposite end of the lift. Since the lift is angled, during the lifting process the watercraft will be supported at an angle with respect to its level or operational attitude. Furthermore, the angled condition of the lift makes it impossible for the watercraft to approach the lift in reverse, that is stern rather than bow first, because the propeller will not clear the lift frame. Presently known front mounted lifts also are limited in design by the torque exerted on the dock by the cantilevered weight of the lift which often results in damage to the dock. Some front mounted lifts use chains or ropes connected from the rear of the lift to limit its downward travel. Others allow the lift to rest on bottom when it is lowered. Still others limit the length of the lift and therefore the type of watercraft which can be raised and lowered by it.

It is, therefore, an object of this invention to provide a front mounted lift for watercraft which substantially maintains the watercraft in its operational or level attitude throughout the lifting and lowering processes. It is another object of this invention to provide a front mounted lift for watercraft which may be approached by the watercraft either the bow or stern first. Yet another object of this invention is to provide a lift for watercraft which reduces the torque applied by the lift to the dock. Similarly, it is an object of this invention to provide a front mounted lift for watercraft which does not require the use of chains or ropes to support the rear of the lift. It is also an object of this invention to provide a front mounted lift for watercraft which does not rest on the bottom when in the lowered condition. And it is an object of this invention to provide a front mounted lift for watercraft which is capable of supporting a variety of types and size of craft while minimizing the possibility of damage to the dock.

SUMMARY OF THE INVENTION

In accordance with the invention, a front mounted lift for watercraft is provided in which two pair of parallel arms are pivotally mounted between the dock and the lift. One of the ends of each pair of arms is journalled to the dock or the lift on horizontal shafts, preferably spaced apart on common vertical axes. The shafts function as torsion members and maintain the lift in a substantially level lateral attitude. The other of the ends of each pair of parallel arms are pivotally attached, preferably on common vertical axes, to either the lift or the dock, at the same spacing as their opposing ends. Thus, the pivotal arms move in a parallelogram relationship while the lift mounted at one end of the arms maintains its lengthwise level attitude in relation to the dock. Raising the lift is accomplished by the introduction of air into a pair of tanks supporting the lift. Preferably, the tanks will extend from front to rear of the lift and will be divided into front and rear compartments. Thus, while the arms maintain the lift in its lengthwise level attitude, the air distributed to the tank compartments may be controlled so as to maintain the natural balance of the lift in a lengthwise level attitude. Preferably, the air control is accomplished by the connection of corresponding tank compartments to a common air hose so that compensation can be made fore and aft for misbalanced loads by directing additional air to the heavy end of the lift. The torque exerted by the lift on the dock is limited by a combination of a first buoyant force, being air trapped within the tanks, and a second buoyant force, being flotation devices connected to the rear of the lift. In a preferred embodiment, the primary buoyant force is achieved by the extension of an air supply and exhaust hose into each tank compartment to a level below the uppermost level of the tank chamber. Consequently, as air is exhausted through the exhaust hose, the water level in each tank compartment will rise to the point at which the water covers the hose opening. This prevents further exhaustion of air, trapping the remaining air in the tank to provide a buoyant force to counter most of the submerged lift weight. The depth of the hose is selected so that the weight of the lift slightly exceeds the buoyant force. This permits the lift to sink but significantly minimizes the torque exerted on the connection of the lift to the dock. The secondary buoyant force preferably consists of a pair of buoyant guides mounted above and on each side of the rear portion and perhaps extending toward the front portion of the lift, the buoyant force of the guides being sufficient when lowered into the water to prevent the rear of the lift from sinking to an undesirable depth. This secondary force further reduces the torque on the dock. In the preferred embodiment, these buoyant guides will also serve to direct the watercraft into its proper position on the lift during the landing process.

In another embodiment, a single pair of parallel arms is pivotally connected between the dock and lift. In this embodiment, the lateral level altitude of the lift is maintained by the single horizontal shaft connecting the arms and the lengthwise level attitude of the lift is maintained solely by the control of air to the tank compartments to maintain the fore and aft balance of the lift.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
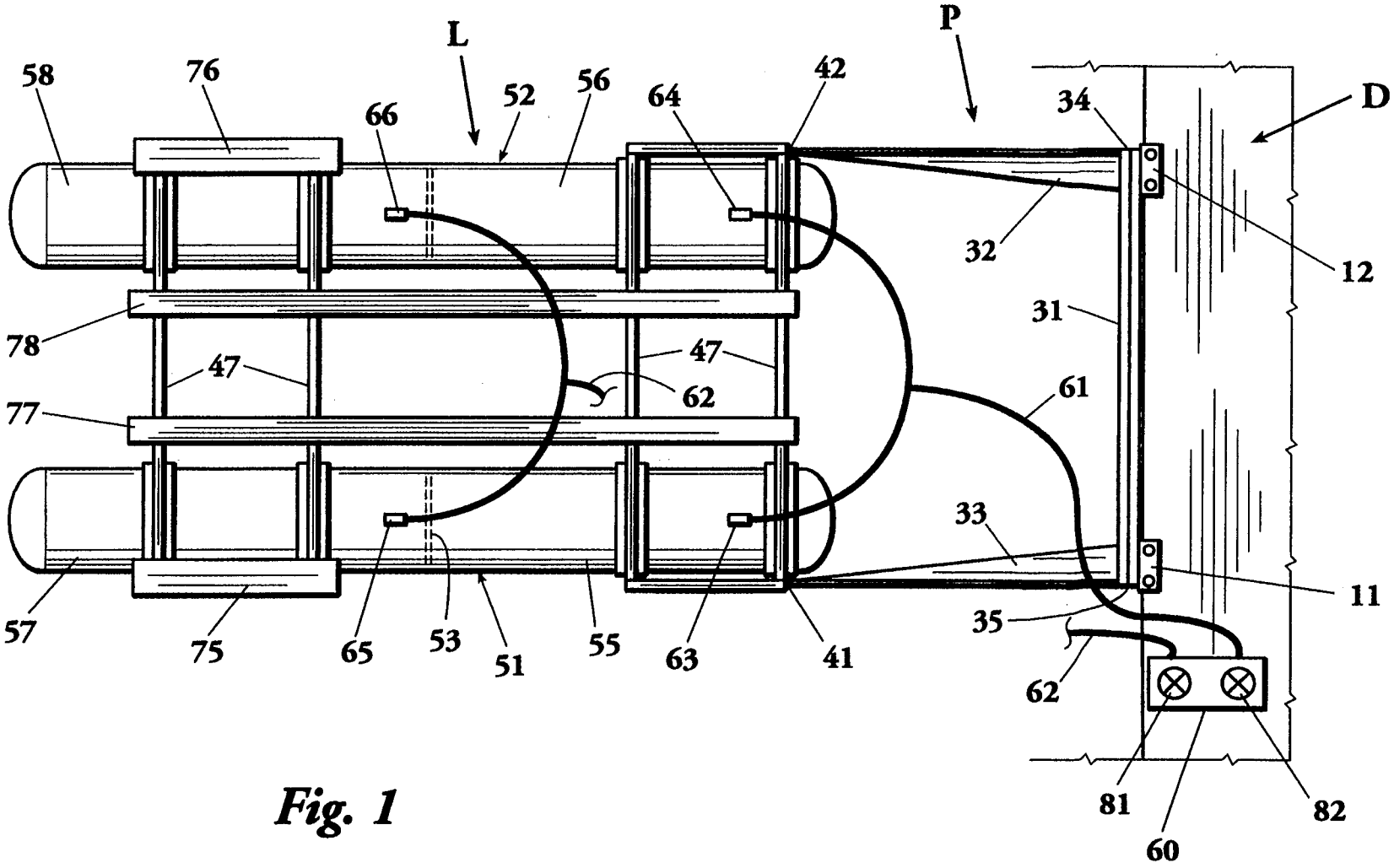
FIG. 1 is a is a top plan view illustrating a preferred embodiment of the front mounted lift.
Figure 2:
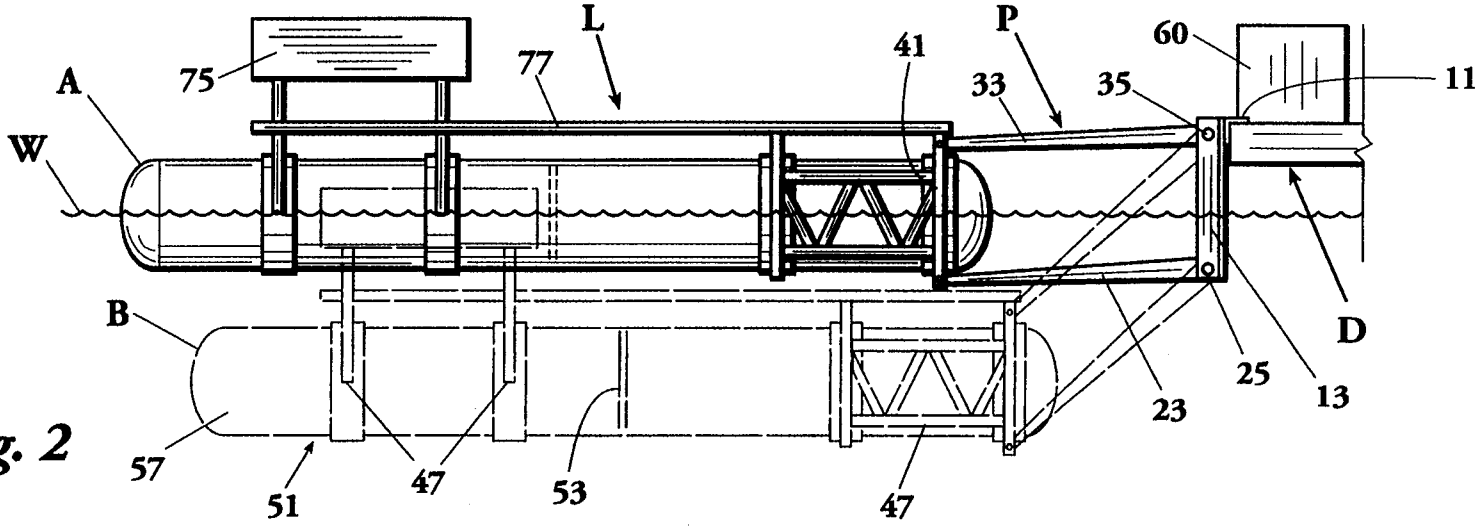
FIG. 2 is a side elevation view illustrating the lift of FIG. 1 in the raised and lowered conditions.

A preferred embodiment of a lift L front mounted to a dock D by a pivotal connector P is illustrated in FIGS. 1 and 2. The pivotal connector P of this embodiment is illustrated in greater detail in FIG. 4. From the vantage point of one standing on the dock D, left and right dock brackets 11 and 12 are bolted or otherwise secured to the edge of the dock D and left and right vertical brackets 13 and 14 extend downwardly from the dock brackets 11 and 12 into the water W, as is best seen in FIG. 2. A lower pivot assembly 20 consists of a horizontal shaft 21 with parallel right and left lower arms 22 and 23 extending transversely from the axis thereof. The lower shaft 21 extends slightly beyond the arms 22 and 23 to provide extended portions 24 and 25 which are journalled for rotation in apertures 26 and 27 in the lower right and left brackets. The ends of the arms 22 and 23 which are not connected to the shaft 21 are provided with lift apertures 28 and 29. An upper pivot assembly 30 consists of an upper horizontal shaft 31 to which are fixed right and left upper arms 32 and 33 parallel to each other and transverse to the axis of the shaft 31. The shaft extends slightly through the arms 32 and 33 to provide extended portions 34 and 35 which are journalled in apertures 36 and 37 in the upper right and left brackets. The ends of the arms 32 and 33 which are not connected to the shaft 31 are provided with lift apertures 38 and 39. Vertical support members 41 and 42 are provided with upper lift apertures 43 and 44 and lower lift apertures 45 and 46 for pivotal engagement with the arms 22, 23, 32 and 33 via the lift apertures 26, 27, 36 and 37 on pins (not shown) inserted therethrough. The distances between the lower apertures 26 and 27 and the upper apertures 36 and 37 on the dock brackets 13 and 14 are equal to the distances between the upper apertures 43 and 44 and the lower apertures-44 and 46 on the lift vertical supports 41 and 42. Similarly, the distances from the horizontal shafts 21 and 31 to the apertures 28 and 29 and 38 and 39 on the opposite ends of the arms 22, 23 and 32 and 33 are equal, so that the pivotal connector P is a flex jointed parallelepiped in which the vertical support members 41 and 42 remain in parallel or vertical relationship to the dock brackets 13 and 14 throughout the range of rotation of the arms 22, 23, 32 and 33 with the horizontal shafts 21 and 31. Consequently, the attitude of a load connected to the vertical supports 41 and 42 will remain constant throughout the operation of the pivotal connector P.

The lift L consists of an assembly of frame members 47 secured to a pair of tanks 51 and 52, preferably in parallel spaced apart relationship with their longitudinal axes extending transverse to the horizontal shafts 21 and 31. Preferably, each of the tanks 51 and 52 will be divided by walls 53 and 54 into discrete forward compartments 55 and 56 and rearward compartments 57 and 58. Preferably, the front compartments 55 and 56 will be connected by a Y connector 61 to a compressed air source 60 and the rear compartments 57 and 58 will be connected by a second Y connector 62 to the compressed air source 60. Each Y connector 61 and 62 is controlled by a separate valve at the source 60, which is preferably located on the dock D, each valve permitting selection of connection of its Y connector 61 or 62 to the source 60, to the atmosphere or to a pneumatically closed condition.

As can best be discerned from FIG. 2, the horizontal shafts 21 and 31 maintain the lift in a substantially level lateral attitude while the constant relationship of the vertical supports 41 and 42 throughout the range of motion of the arms 22 and 23 and 32 and 33 maintains the lift L in a substantially level lengthwise attitude.

Figure 5:
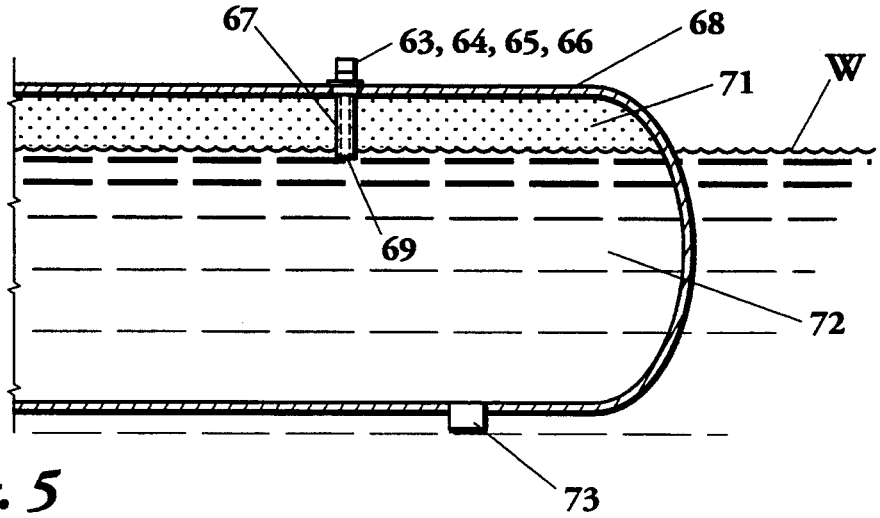
FIG. 5 is a cross-sectional view taken along the line 5—5 of FIG. 1.

As shown in FIG. 2, the pivotal connector P is able to rotate between a raised condition A and the lowered condition B, with the lift L maintained in its substantially level lateral and lengthwise attitude. Observing the lowered condition B, it is readily apparent that the cantilevered condition of the lift L in relation to the dock D could result in a great deal of torque being exerted on the dock D at the point of connection with the dock brackets 11 and 12. In order to minimize this force resulting from the weight of the lift L, a countering force is provided as illustrated in FIG. 5. The inlet/-outlet ports 63, 64, 65 and 66 in each of the tank compartments 55, 56, 57 and 58 includes a hose portion 67 which extends downwardly into the chamber of the tank compartment 55, 56, 57 or 58. The vertical distance between the uppermost wall 68 and the lower opening 69 of the hose portion 67 defines an upper zone or volume of trapped air 71 in the compartment 55, 56, 57 or 58 when water 72 is permitted to enter the compartment 55, 56, 57 or 58 through a water inlet/exhaust opening 73 through the bottom wall of the compartment 55, 56, 57 or 58. As the water 72 covers the lower opening 69 in the hose 67, further exhaust of air through the hose 67 and the Y connector 61 or 62 through the valve 81 or 82 at the air source 60 is blocked. Thus, the total volume of trapped air 71 can be predetermined by adjusting the depths of the hoses 67 in each of the compartments 55, 56, 57 and 58. Preferably, the hose depths selected are such that the total buoyant force of the trapped air 71 in the two compartments is slightly less than the downward force of the weight of the lift L so that, when the level of the water 72 reaches just above the lower openings 69 of the hoses 67, the lift L will tend to sink but with a minimum amount of downward force exerted on the arms 22, 23, 32 and 33.

As seen in FIGS. 1 and 2,.a preferred embodiment of the lift L further includes a pair of parallel spaced apart guide members 75 and 76 and a pair of spaced apart keel support members 77 and 78. As shown, the orientation of the guides 75 and 76 and the keel supports 77 and 78 is in parallel and lengthwise relation with respect to the lift L. However, any orientation is acceptable which accommodates the reception of the keel of the water craft between the keel supports 77 and 78 and receives the aft side walls of the craft between the guides 75 and 76 which maintain the craft in its level or operational attitude throughout the operation of the lift L. In the preferred embodiment shown, the guides 75 and 76 are buoyant members capable of providing sufficient buoyant force to fully counter the weight of the lift L not offset by the trapped air 71 in the tanks 51 and 52 so that as the lift L is lowered in the water W, further downward travel of the lift L will be prevented upon immersion of the guides 75 and 76 into the water W.

Figure 3:
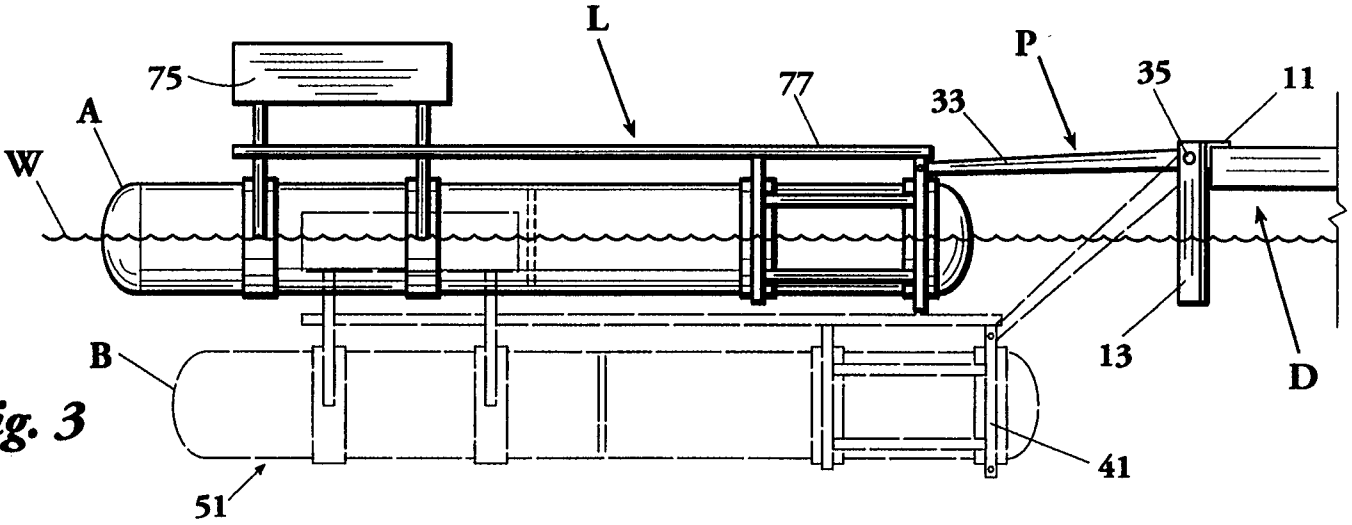
FIG. 3 is a side elevation view of another embodiment of the lift illustrated in the raised and lowered conditions.
Figure 4:
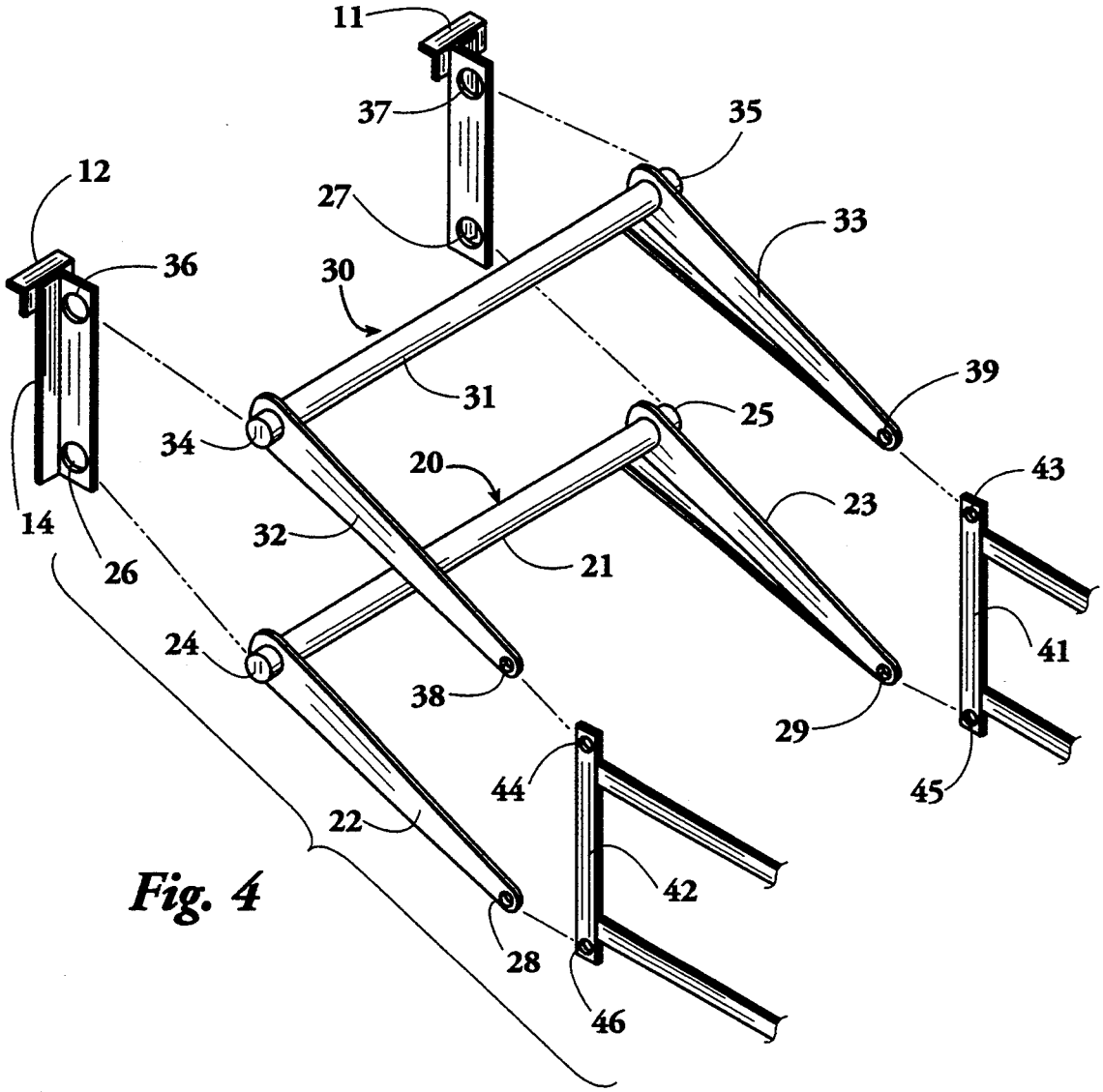
FIG. 4 is a perspective view of the components of a preferred embodiment of the pivotal arms of the lift of FIG. 1 in a disassembled condition.

An alternative embodiment of the invention is illustrated in FIG. 3 in which the pivotal connector P consists of a single pivot assembly 30 including the shaft 31 and the arms 32 and 33 shown in FIG. 4 connected between the dock brackets 13 and 14 and the lift L. In this embodiment, the lateral attitude of the lift L is maintained in substantially level condition by the horizontal shaft 31. However, the lengthwise attitude of the lift L is maintained in substantially level condition only by the controlled distribution of air to the forward compartments 55 and 56 and rearward compartments 57 and 58 of the tanks 51 and 52 so as to balance the load fore and aft. As in the embodiment illustrated in FIG. 2, the depth to which the lift L may be lowered into the water W is determined by the buoyancy of the guides 75 and 76 mounted on the lift L.

Many variations of the pivotal connector P will be apparent to those skilled in the art. As long as the pivotal connector P permits the frame of the lift L to be maintained in a constant attitude throughout the range of motion of the pivotal connector P, the purposes of the pivotal connector P of the present invention are satisfied. Furthermore, the valve system controlling the inlet and exhaust of air and water to and from the tanks 51 and 52 may be of any known configuration. It is necessary only that the water/air ratios in the fore and aft tank compartments 55, 56, 57 and 58 be controllable to maintain the desired lengthwise weight distribution of the lift L. Likewise, the secondary counterbalancing force exerted by the guides 75 and 76 can be accomplished in a variety of ways, including the attachment of any lighter-than-water members to the rear portion of the lift L by ropes, chains or other connecting means of length to provide the desired lowermost depth of the lift L.

Thus, it is apparent that there has been provided, in accordance with the invention, a front mounted boat lift that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A lift for raising and lowering a watercraft out of and into a body of water comprising:

a frame;

means fixed to said frame for supporting the watercraft above the frame;

a flex-jointed arm means journalled at one end thereof to one side of a dock and journalled at another end thereof to said frame for maintaining the watercraft resting on said frame in a longitudinally substantially operational attitude throughout angular motion of said arm; and at least one tank means fixed to said frame and defining a pneumatically discrete cavity having a water passage through a lower wall portion thereof, an air passage through an upper wall portion thereof and means extending said air passage beneath said upper wall portion for trapping a volume of air in an uppermost portion of said cavity as air is released from said cavity through said air passage and water is admitted into said cavity until said air passage is blocked thereby, to provide a degree of buoyancy to the lift as the lift sinks in the body of water.

2. A lift according to claim 1, said extending means being slidably disposed through said hole in said tank for selecting said volume of air to be trapped in said tank by selecting the level of an end of said extending means within said tank.

3. A lift according to claim 1, said flex-joined arm means being journalled for rotation about a horizontal axis of at least one shaft for maintaining the watercraft resting on said frame in a laterally substantially operational attitude throughout angular motion of said arm.

4. A lift according to claim 3, said at least one shaft comprising upper and lower horizontal shafts journalled for rotation on the dock and said flex-jointed arm means further comprising:

first left and right radial members fixed proximate one end thereof to and spaced apart on said upper shaft for rotation therewith and second left and right radial members fixed proximate one end thereof to and spaced apart on said lower shaft for rotation therewith, said radial members being of substantially equal length;

a left linking member journalled proximate one end thereof proximate another end of said fist left radial member and journalled proximate another end thereof proximate another end of said second left radial member and a right linking member journalled proximate one end thereof proximate another end of said first right radial member and journalled proximate another end thereof proximate another end of said second right radial member, said linking members being of length substantially equal to the distance between said shafts and fixed to said frame.

5. A lift according to claim 3, said flex-jointed arm means comprising left and right radial members fixed proximate one end thereof to and spaced apart on said shaft for rotation therewith and journalled proximate another end thereof to said frame.

6. A lift according to claim 5, said tank being divided into pneumatically discrete compartments and the lift further comprising means for varying the volume of air contained in each of said compartments to maintain the watercraft in a longitudinally substantially operational attitude.

7. A lift for raising and lowering a watercraft out of and into a body of water comprising:

upper and lower horizontal shafts journalled for rotation on a dock;

first left and right radial members fixed proximate one end thereof to and spaced apart on said upper shaft for rotation therewith and second left and right radial members fixed proximate one end thereof to and spaced apart on said lower shaft for rotation therewith, said radial members being of substantially equal length;

a left linking member journalled proximate one end thereof proximate another end of said first left radial member and journalled proximate another end thereof proximate another end of said second left radial member and a right linking member journalled proximate one end thereof proximate another end of said first right radial member and journalled proximate another end thereof proximate another end of said second right radial member, said linking members being of length substantially equal to the distance between said shafts;

a frame fixed to said linking members;

means fixed to said frame for supporting the watercraft above the frame; and a pair of parallel, horizontal, spaced-apart, elongated tanks fixed to said frame and transverse to said shafts, each defining a pneumatically discrete cavity having a water passage through a lower wall portion thereof, an air passage in an upper portion thereof and a hose extending from said air passage into said cavity below an uppermost portion of said cavity for trapping a volume of air in said uppermost portion of said cavity as air is released from said cavity through said air passage and water is admitted into said cavity until said air passage is blocked thereby, to provide a degree of buoyancy to the lift as the lift sinks in the body of water.

8. A lift for raising and lowering a watercraft out of and into a body of water comprising:

upper and lower horizontal shafts journalled for rotation on a dock;

first left and right radial members fixed proximate one end thereof to and spaced apart on said upper shaft for rotation therewith and second left and right radial members fixed proximate one end thereof to and spaced apart on said lower shaft for rotation therewith, said radial members being of substantially equal length;

a left linking member journalled proximate one end thereof proximate another end of said first left radial member and journalled proximate another end thereof proximate another end of said second left radial member and a right linking member journalled proximate one end thereof proximate another end of said first right radial member and journalled proximate another end thereof proximate another end of said second right radial member, said linking members being of length substantially equal to the distance between said shafts;

a frame fixed to said linking members;

means fixed to said frame for supporting the watercraft above the frame;

a pair of parallel, horizontal, spaced-apart, elongated tanks fixed to said frame and transverse to said shafts, each divided into at least two pneumatically discrete compartments having a water passage through a lower wall portion thereof, an air passage in an upper portion thereof and a hose extending from said air passage into said compartment below an uppermost portion of each said compartment for trapping a volume of air in said uppermost portion of each said cavity as air is released from said compartment through said air passage and water is admitted into said compartment until said air passage is blocked thereby, to provide a degree of buoyancy to the lift as the lift sinks in the body of water; and means for varying the volume of air contained in each of said compartments to maintain the watercraft in longitudinally substantially operational attitude.

9. A lift according to claim 8, said varying means comprising:

a source of compressed air;

at least two pneumatically discrete flow paths, one extending from said source to each of corresponding ones of said compartments in each said tank; and at least two valves, one in each said path, for selectively connecting said corresponding ones of said compartments to said source, to the atmosphere and to a pneumatically closed condition.

10. A lift for raising and lowering a watercraft out of and into a body of water comprising:

a frame;

a horizontal shaft journalled for rotation on a dock;

left and right radial members fixed proximate one end thereof to and spaced apart on said shaft for rotation therewith and journalled proximate another end thereof to said frame;

means fixed to said frame for supporting the watercraft above the frame; and a pair of parallel, horizontal, spaced-apart, elongated tanks fixed to said frame and transverse to said shafts, each defining a pneumatically discrete cavity having a water passage through a lower wall portion thereof, an air passage in an upper portion thereof and a hose extending from said air passage into said cavity below an uppermost portion of said cavity for trapping a volume of air in said uppermost portion of said cavity as air is released from said cavity through said air passage and water is admitted into said cavity until said air passage is blocked thereby, to provide a degree of buoyancy to the lift as the lift sinks in the body of water.

11. A lift for raising and lowering a watercraft out of and into a body of water comprising:

a frame;

a horizontal shaft journalled for rotation on a dock;

left and right radial members fixed proximate one end thereof to and spaced apart on said shaft for rotation therewith and journalled proximate another end thereof to said frame;

means fixed to said frame for supporting the watercraft above the frame;

a pair of parallel, horizontal, spaced-apart, elongated tanks fixed to said frame and transverse to said shafts, each divided into at least two pneumatically discrete compartments having a water passage through a lower wall portion thereof, an air passage in an upper portion thereof and a hose extending from said air passage into said compartment below an uppermost portion of each said compartment for trapping a volume of air in said uppermost portion of each said compartment as air is released from said compartment through said air passage and water is admitted into said compartment until said air passage is blocked thereby, to provide a degree of buoyancy to the lift as the lift sinks in the body of water; and means for varying the volume of air contained in each of said compartments to maintain the watercraft in a longitudinally substantially operational attitude.

12. A lift according to claim 11, said varying means comprising:

a source of compressed air;

at least two pneumatically discrete flow paths, one extending from said source to each of corresponding ones of said compartments in each said tank; and at least two valves, one in each said path, for selectively connecting said corresponding ones of said compartments to said source, to the atmosphere and to a pneumatically closed condition.

* * * * *